US007507064B2

(12) United States Patent
Shibuya

(10) Patent No.: US 7,507,064 B2
(45) Date of Patent: Mar. 24, 2009

(54) LIFT ARM DEVICE FOR INDUSTRIAL VEHICLE, INDUSTRIAL VEHICLE HAVING THE SAME AND METHOD OF RAISING AND LOWERING LIFT ARM

(75) Inventor: Osamu Shibuya, Kariya (JP)

(73) Assignee: Kabushiki Kaisha Toyota Jidoshokki, Kariya_Shi (JP)

( * ) Notice: Subject to any disclaimer, the term of this patent is extended or adjusted under 35 U.S.C. 154(b) by 336 days.

(21) Appl. No.: 11/371,982

(22) Filed: Mar. 8, 2006

(65) Prior Publication Data

US 2006/0243234 A1 Nov. 2, 2006

(30) Foreign Application Priority Data

Mar. 9, 2005 (JP) ..... 2005-064855

(51) Int. Cl.
*B66C 23/00* (2006.01)

(52) U.S. Cl. ..... 414/686; 414/685

(58) Field of Classification Search ..... 414/685, 414/686; 212/255, 260, 261
See application file for complete search history.

(56) References Cited

U.S. PATENT DOCUMENTS

| | | | | |
|---|---|---|---|---|
| 5,169,278 | A | 12/1992 | Hoechst et al. | 414/685 |
| 5,470,190 | A | 11/1995 | Bamford et al. | 414/686 |
| 6,474,933 | B1 | 11/2002 | Hoechst et al. | 414/815 |
| 6,705,826 | B1 | 3/2004 | Callens | 414/686 |

FOREIGN PATENT DOCUMENTS

| | | |
|---|---|---|
| JP | 3133793 | 11/2000 |

*Primary Examiner*—Donald Underwood
(74) *Attorney, Agent, or Firm*—Locke Lord Bissell & Liddell

(57) ABSTRACT

A lift arm device for an industrial vehicle includes a lift arm, a connecting rod and first and second cylinders. The lift arm has a front end to which a working implement is connected. The connecting rod is pivotally connected at one end to the lift arm and pivotally joined at the other end to the vehicle. Each of the first and second cylinders is pivotally connected at one end to the lift arm and pivotally joined at the other end to the vehicle.

11 Claims, 8 Drawing Sheets

LIFT ARM DEVICE FOR INDUSTRIAL VEHICLE, INDUSTRIAL VEHICLE HAVING THE SAME AND METHOD OF RAISING AND LOWERING LIFT ARM

BACKGROUND

The present invention relates to a lift arm device and an industrial vehicle having the lift arm device.

Japanese Patent No. 3133793 indicates that, in a skid steer loader having a loader boom which is mounted at a single pivotal axis to the frame of the skid steer loader, the outer front end of the loader boom travels along an arcuate path when the boom is raised or lowered, with the result that the forward reach of a working implement such as bucket provided at the front end of the loader boom tends to be shortened.

In order to solve such problem, the following construction is disclosed in Japanese Patent No. 3133793. A main lift arm section to which a bucket is attached is connected to the main frame of the loader through two links (or a rear lift arm link and a rigid link) and an actuator. Each of the two links and the actuator is connected at one end thereof to the main lift arm section through a pin and at the other end thereof to the main frame of the loader through a pin.

According to the Patent, the main lift arm can have a longer reach in the upper region of its path of movement, so that loading and unloading operation, such as unloading into a truck and making a higher pile, can be performed easily.

U.S. Pat. No. 6,705,826 discloses a lift truck which includes a boom whose proximal end is pivotally connected not directly to a mobile frame but to a support which can be moved horizontally in the longitudinal direction of the frame. When the boom is raised by one cylinder, the support is displaced by another cylinder. Thus, the front end of the boom travels in an almost vertical path, thereby increasing the load capacity. Each of the two cylinders is pivotally connected at one end thereof to the frame and at the other end thereof to the boom or the support.

In the skid steer loader disclosed in the above-cited Japanese Patent No. 3133793, a longer reach of the main lift arm section is obtained in the raised position of the lift arm. However, the skid steer loader has no degree of freedom for the path of movement of the lift arm. In order to change the path of movement that has been set once, the lift arm and its associated parts need to be modified significantly. Therefore, it has been hard for the conventional skid steer loader to be used under various conditions or for various specific purposes.

In the lift truck disclosed in U.S. Pat. No. 6,705,826, the operation of the cylinder for displacing the support is determined by the control as shown in FIGS. 6 through 10 of the patent in accordance with the raised amount of the boom by the other cylinder. Thus, it is hard for the above lift truck to provide the degree of freedom for the path of movement of the lift arm. Furthermore, the lift truck having the support which is moved horizontally in the longitudinal direction of the frame needs to increase the displaced amount of the support for obtaining a longer reach of the boom in an upper raised position. Thus, a larger space is needed for movement of guide means for the support (or horizontal rod 18) and the support, which causes its raising and lowering device and hence the industrial vehicle to be made larger in size.

SUMMARY

According to the present invention, a lift arm device for an industrial vehicle includes a lift arm, a connecting rod and first and second cylinders. The lift arm has a front end to which a working implement is connected. The connecting rod is pivotally connected at one end to the lift arm and pivotally joined at the other end to the vehicle. Each of the first and second cylinders is pivotally connected at one end to the lift arm and pivotally joined at the other end to the vehicle.

The present invention also provides a lift arm device for an industrial vehicle which includes a lift arm, a first cylinder and a second cylinder. The lift arm has a front end to which a working implement is connected. The first cylinder is pivotally connected at a first connection point to the lift arm and joined at the other end to the vehicle. The second cylinder is pivotally connected at a second connection point to the lift arm and joined at the other end to the vehicle. One of the first and second connection points corresponds to a guide connection point guided for movement in a direction that forms an angle with a horizontal plane.

The present invention also provides a method of raising and lowering a lift arm in an industrial vehicle. The lift arm has a front end to which a working implement is connected. The method includes the steps of: pivotally connecting a connecting rod at one end to the lift arm and pivotally joining at the other end to the vehicle; pivotally connecting a first cylinder at one end to the lift arm and pivotally joining at the other end to the vehicle; pivotally connecting a second cylinder at one end to the lift arm and pivotally joining at the other end to the vehicle; extending the first cylinder when the lift arm is raised from a lowermost position to an uppermost position; retracting the second cylinder during the period of extending the first cylinder; and extending the second cylinder during the period of extending the first cylinder after the second cylinder retracts.

The present invention also provides a method of raising and lowering a lift arm in an industrial vehicle. The lift arm has a front end to which a working implement is connected. The method includes the steps of: connecting a first cylinder at a first connection point pivotally to the lift arm and joining at the other end to the vehicle; connecting a second cylinder at a second connection point pivotally to the lift arm and joining at the other end to the vehicle; guiding one of the first and second connection points for movement in a direction that forms an angle with a horizontal plane; extending the first cylinder when the lift arm is raised from a lowermost position to an uppermost position; retracting the second cylinder during the period of extending the first cylinder; and extending the second cylinder during the period of extending the first cylinder after the second cylinder retracts.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
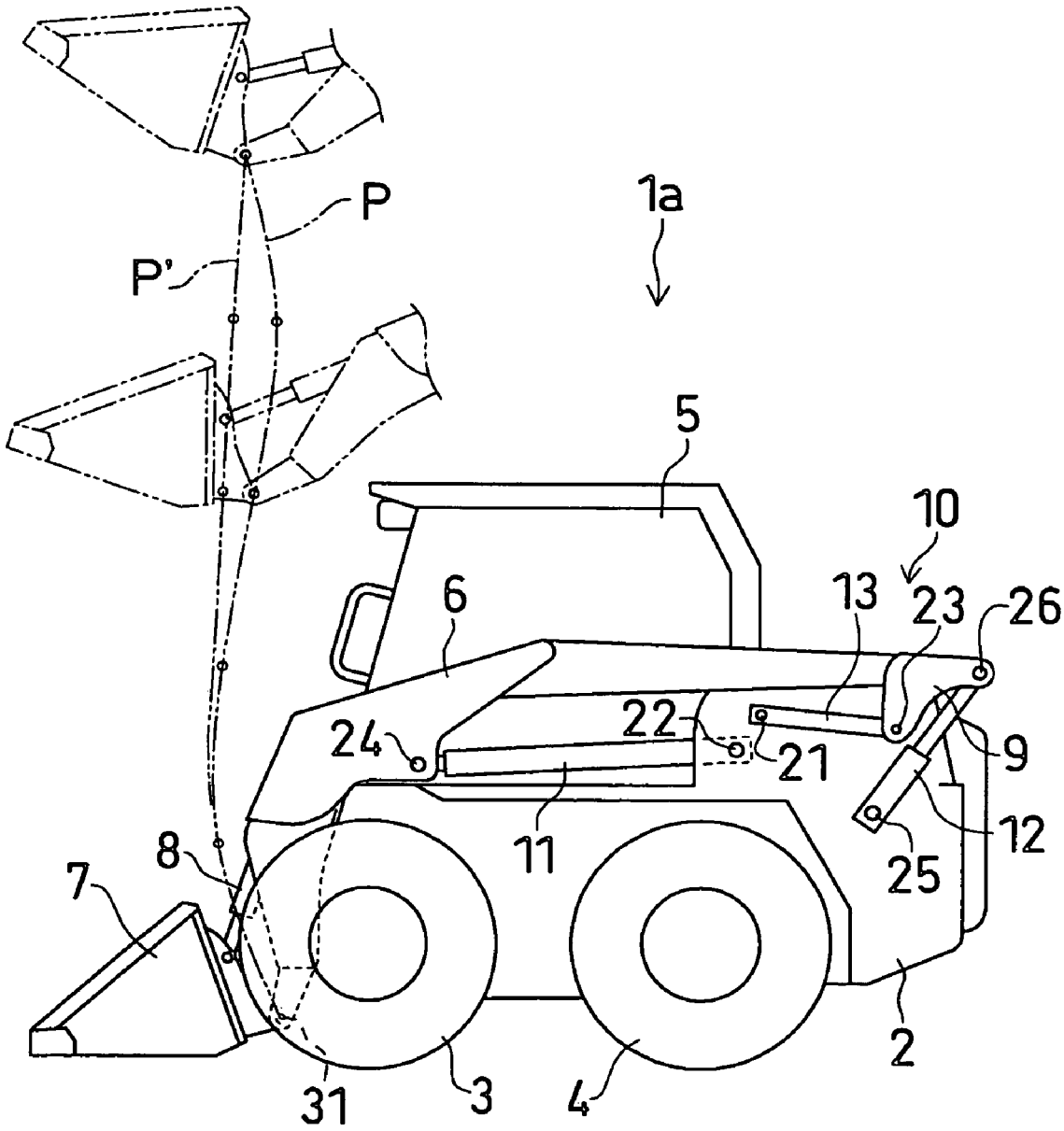
FIG. 1 is a side view of a skid steer loader according to a first preferred embodiment of the present invention showing a state where a lift arm is located at the lowermost position and also showing a bucket and the lift arm in a plurality of positions.

The following describes a skid steer loader (an industrial vehicle) according to a first preferred embodiment of the present invention with reference to FIGS. 1 through 6. Referring to FIG. 1 showing a side view of the skid steer loader which is generally designated by reference numeral 1*a*, it includes a frame-like base 2, front wheels 3 and rear wheels 4 which are supported by the base 2. The front and rear wheels 3 and 4 are driven to rotate by a driving means such as vehicle engine (not shown) provided in the base 2. A cabin 5 is mounted on the base 2 in which an operator's seat is accommodated. A counter weight (not shown) is provided in the base 2. The skid steer loader 1*a* further includes a lift arm 6 having a front end to which a bucket (working implement) 7 is pivotally connected through a pin 31. A bucket cylinder 8 is provided adjacent to the front end of the lift arm 6 for pivoting the bucket 7.

The lift arm 6 is operable to be raised and lowered by a raising and lowering device 10 that will be described later. It is noted that FIG. 1 shows the state of the skid steer loader 1*a* where the lift arm 6 is lowered to the lowermost position.

A connecting rod 13 is pivotally connected at its front end to the rear portion of the base 2 through a pin 21. Alternatively, the connecting rod 13 may also be joined to the vehicle by an indirect connection from its front end to the pin 21 at the rear portion of the base 2 through a linkage or the like. A lift cylinder (or first cylinder) 11 is pivotally connected at the end on the cylinder portion side (or base end) thereof through a pin 22 to the base 2 at a position forward of the pin 21 for the connecting rod 13. Alternatively, the lift cylinder 11 may also be joined to the vehicle by an indirect connection from its base end to the pin 22 at the base 2 at the position forward of the pin 21 for the connecting rod 13 through a linkage or the like. The connecting rod 13 is pivotally connected at its rear end through a pin 23 to a counter arm 9 that is fixed to the proximal end of the lift arm 6. The lift cylinder 11 is pivotally connected at the other end on the movable rod side (or rod end) thereof to the middle portion of the lift arm 6 through a pin 24.

A counter cylinder (or second cylinder) 12 is pivotally connected at the end on the cylinder portion side (or base end) thereof through a pin 25 to the base 2 at a position rearward of the pin 21. Alternatively, the counter cylinder 12 may also be joined to the vehicle by an indirect connection from its base end to the pin 25 at the base 2 at the position rearward of the pin 21 through a linkage or the like. The counter cylinder 12 is pivotally connected at the other end on the movable rod side (or rod end) thereof to the counter arm 9 of the lift arm 6 through a pin 26.

Though not shown in the drawing, the lift arm 6, the lift cylinder 11, the counter cylinder 12, the connecting rod 13 and the like shown in FIG. 1 are provided on each side of the cabin 5 in a paired manner. The lift cylinder 11 and the counter cylinder 12 are hydraulic cylinders. The lift cylinder 11 and the counter cylinder 12 are connected to a hydraulic pressure supply means (e.g. an oil pump connected to the vehicle engine) through a control valve (e.g. an electromagnetic valve). The hydraulic pressure supply means and the control valve are not shown in the drawings. The opening and closing operation of the control valve is controlled by a control means, such as a microcomputer controller, which is not shown in the drawings.

In the first preferred embodiment, the lift cylinder 11, the counter cylinder 12 and the connecting rod 13 are the major parts that constitute the raising and lowering device 10 for the lift arm 6. The connection points of the counter cylinder 12 (or the pin 26), the connecting rod 13 (or the pin 23) and the lift cylinder 11 (or the pin 24) to the lift arm 6 are arranged in this order as seen from the proximal end of the lift arm 6 toward the front end thereof.

The following will describe the operation of the raising and lowering device 10 when raising the lift arm 6 for loading or unloading operation. In FIG. 1 where the lift arm 6 is located at the lowermost position indicated by the solid line, the cylinder rod of the lift cylinder 11 is fully retracted while the cylinder rod of the counter cylinder 12 is extended to an appropriate position. The lift cylinder 11 is directed substantially horizontally toward the front of the vehicle as seen from the pin 22, and the counter cylinder 12 is tilted toward the rear of the vehicle as seen from the pin 25. The connecting rod 13 is directed substantially horizontally toward the rear of the vehicle as seen from the pin 21.

In this state, when the operator seated on the operator's seat in the cabin 5 manipulates an operating means (e.g. a lever or a pedal) which is not shown in the drawings, oil under pressure is supplied to the lift cylinder 11, so that the lift cylinder 11 is extended thereby to raise the lift arm 6.

Figure 2:
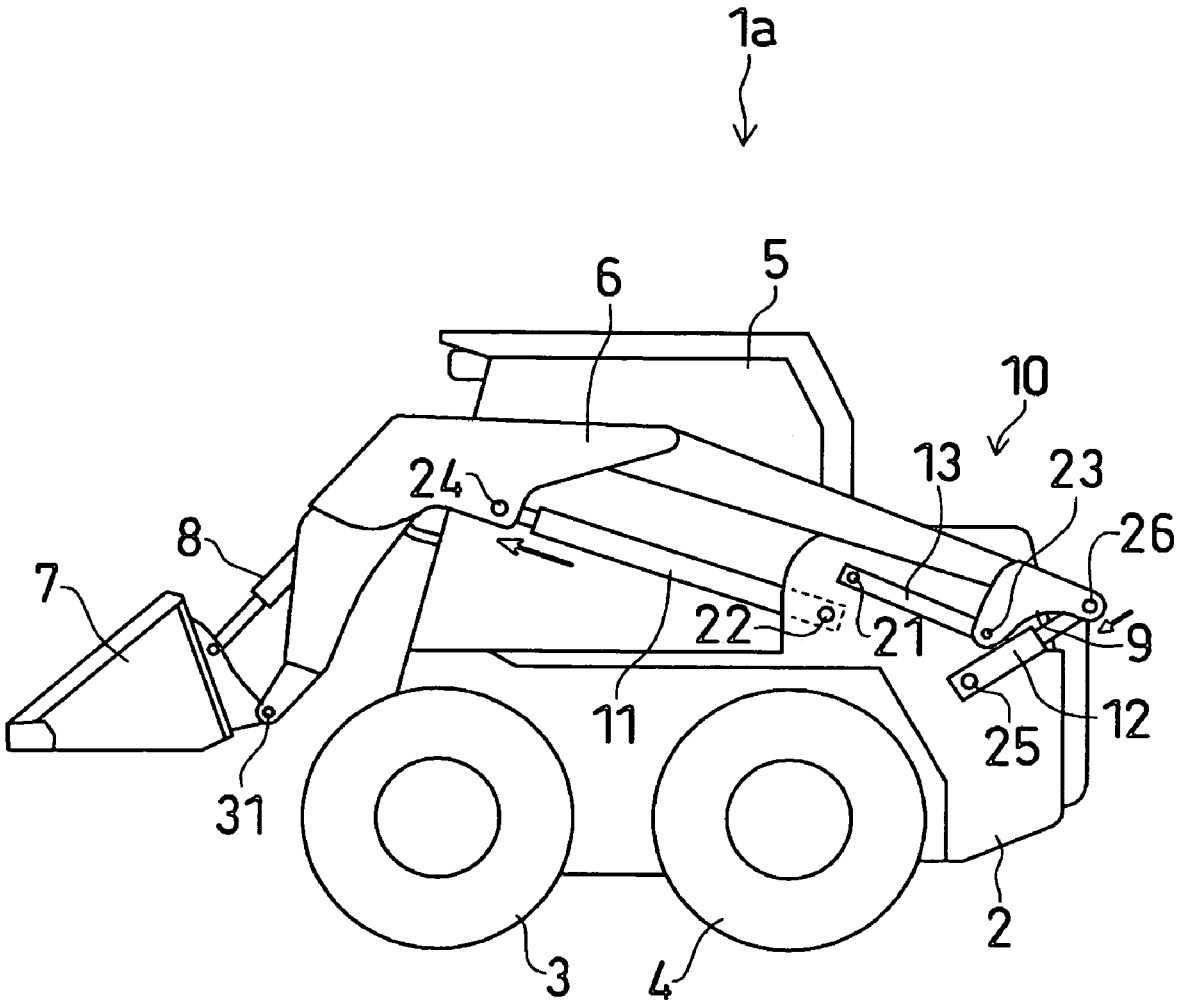
FIG. 2 is a side view of the skid steer loader according to the first preferred embodiment showing a state where a lift cylinder is extended and a counter cylinder is retracted during the initial period of raising the lift arm.
Figure 3:
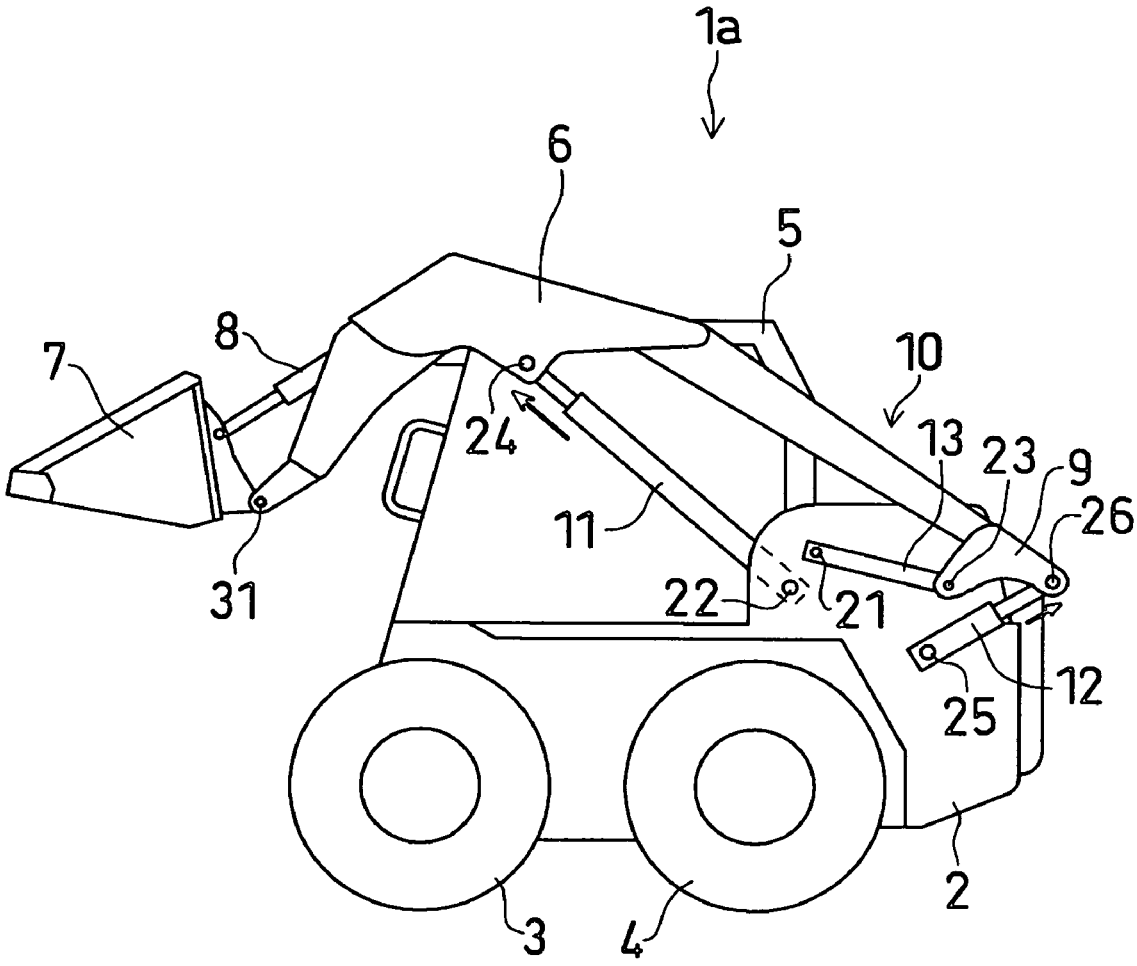
FIG. 3 is a side view of the skid steer loader according to the first preferred embodiment showing a state where the bucket is raised at a medium position.
Figure 4:
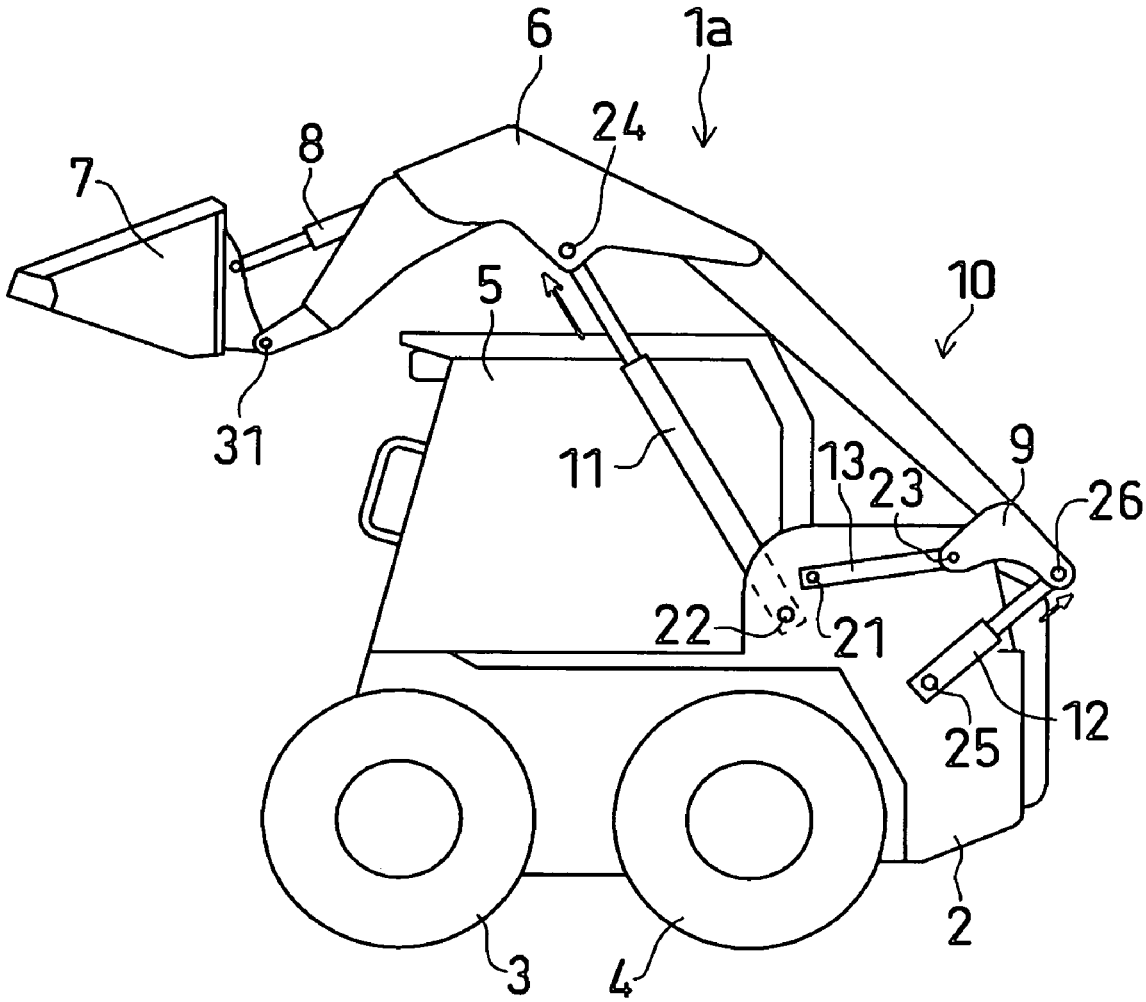
FIG. 4 is a side view of the skid steer loader according to the first preferred embodiment showing a state where the lift cylinder and the counter cylinder are extended to raise the lift arm.
Figure 5:
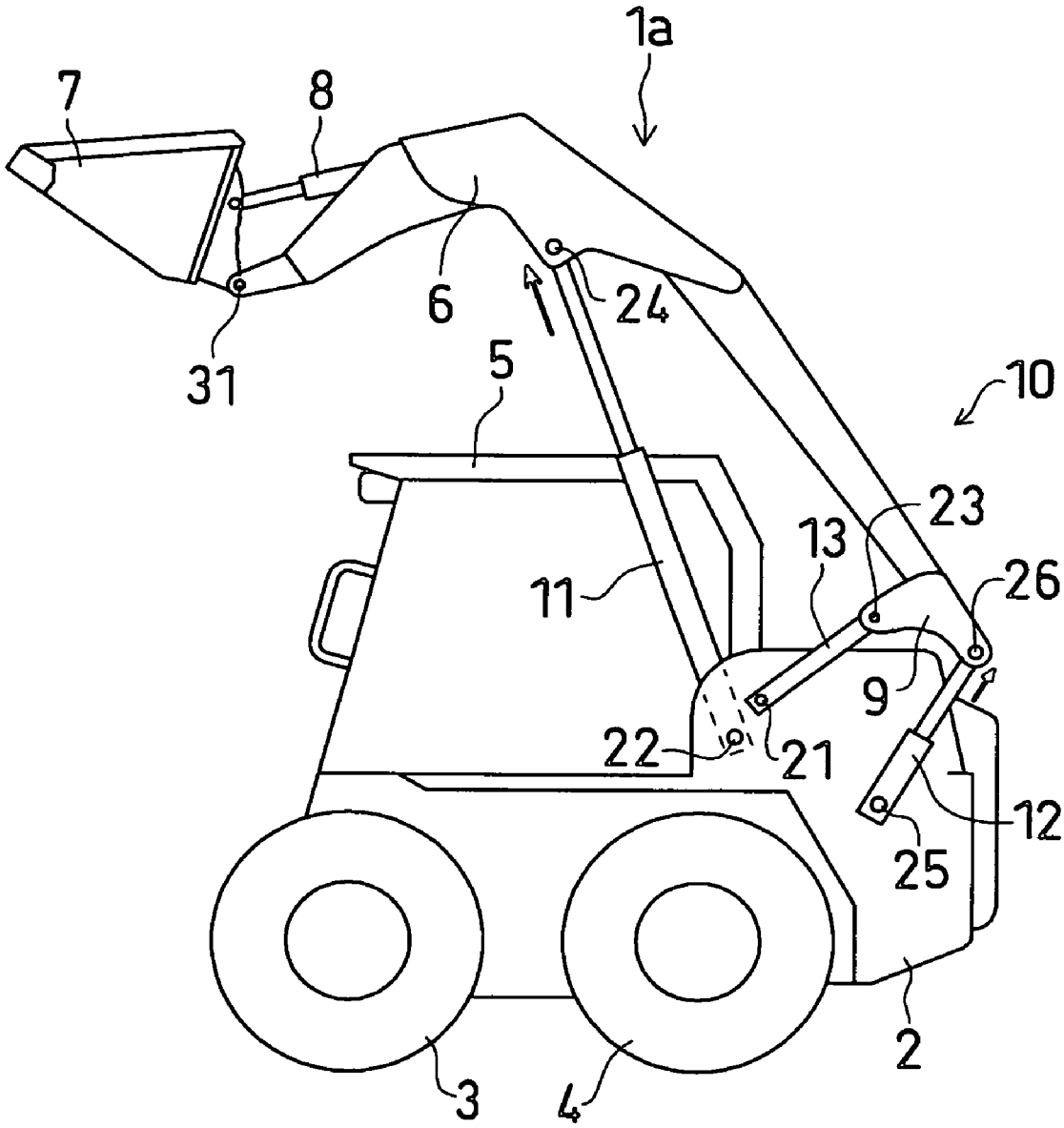
FIG. 5 is a side view of the skid steer loader according to the first preferred embodiment showing a state where the lift arm is raised further.

During the initial period of raising the lift arm 6 (from FIG. 1 to FIG. 2), the counter cylinder 12 and the lift cylinder 11 are controlled by the controller such that the counter cylinder 12 is retracted simultaneously with the extension of the lift cylinder 11, as indicated by arrows in FIG. 2. Due to the retraction of the counter cylinder 12, the rear end of the counter arm 9 of the lift arm 6 is moved downwardly and forwardly, or pivoted clockwise as seen by comparison of FIGS. 1 and 2. The lift arm 6 and the bucket 7 which are thus being raised are moved slightly rearward of the vehicle. As a result, the front end of the lift arm 6 moved during the initial period of raising the lift arm 6 describes a substantially vertical path which does not project excessively forwardly of the vehicle.

Figure 6:
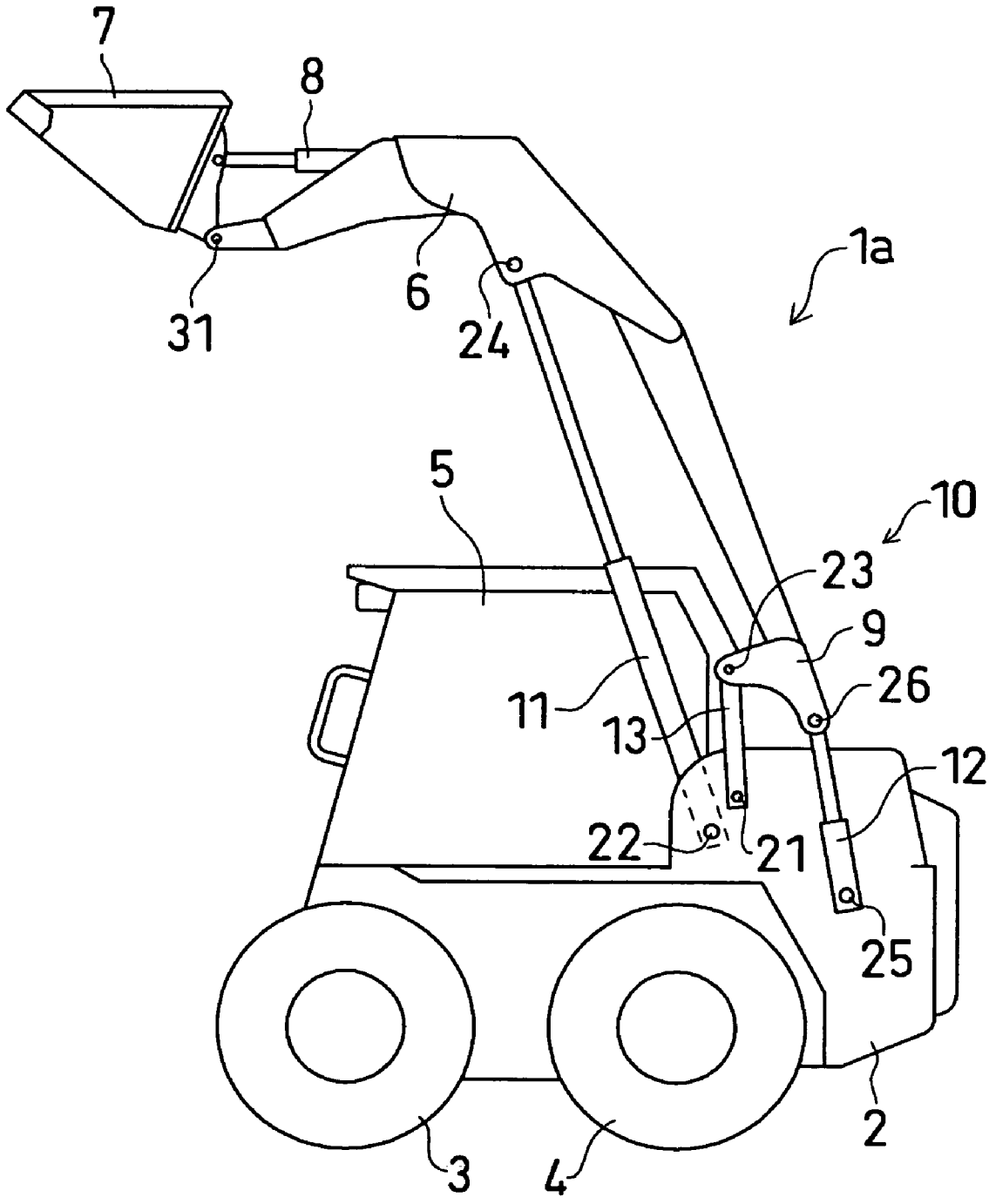
FIG. 6 is a side view of the skid steer loader according to the first preferred embodiment showing a state where the lift arm is located at the uppermost position.

After the bucket 7 has been raised substantially to the height of the pin 21, the counter cylinder 12 is extended with the extension of the lift cylinder 11, as shown in FIGS. 3 through 6. Thus, the connecting rod 13 is pivoted counterclockwise as shown in FIGS. 3 through 6 and shifted from the downwardly tilted position in FIG. 3 to a substantially upright position in FIG. 6. During such movement of the connecting rod 13, the counter arm 9 of the lift arm 6 is moved upwardly and forwardly, as shown in the drawings. Thus, the lift arm 6 and the bucket 7 are raised while moving slightly forwardly until the lift arm 6 reaches its uppermost position as shown in FIG. 6.

As described above, in the skid steer loader 1*a* of the first preferred embodiment, the counter cylinder 12, which is retracted during the initial period of extending the lift cylinder 11, is extended during the middle and late period of extending the lift cylinder 11. Controlling the two cylinders 11 and 12 simultaneously in the above-described manner, the front end of the lift arm 6 is moved slightly rearwardly during the initial period of raising the lift arm 6, but it is moved slightly forwardly during the late period of raising the lift arm 6. As a result, the path P of movement of the front end (the pin 31) of the lift arm 6, to which the bucket 7 is connected, describes a gently S-shaped curve, as indicated by the chain double-dashed line in FIG. 1. It is noted that the operation for lowering the lift arm 6 is performed in the reversed manner to the above operation for raising the lift arm 6.

Compared to the case where the front end of the lift arm travels along an arcuate curve while being raised and lowered, the above-described skid steer loader 1*a* achieves a longer reach in the raised position of the lift arm 6, thereby improving the workability in loading and unloading operation and increasing the maximum load capacity of the vehicle.

Unlike the skid steer loader disclosed in the Japanese Patent No. 3133793, the retracting and extending operation of the counter cylinder 12 is changed according to the retraction and extension of the lift cylinder 11 thereby to vary the path P of movement of the front end of the lift arm 6. Thus, appropriate paths are achieved to suit various working conditions such as preferences of a user and purpose of work. For example, by changing the path P to the path P' in which a longer reach is obtained in the medium and high positions of the bucket 7, the vehicle may be used suitably for loading and unloading operation in the medium and high positions rather than only in a high position near the upper limit of the lift.

Thus, according to the present invention, the path of movement of the front end of the lift arm 6 can be changed without remodeling the raising and lowering device 10, but merely by varying the lengths of extension and retraction of the cylinders 11 and 12. Therefore, loading and unloading work can be performed with a desirable path of movement of the front end of the lift arm 6 depending on, for example, the working preferences of the operator and the type of work, which makes the loading and unloading work easier and is hence convenient for the operator. A plurality of different paths of movement of the front end of the lift arm 6 are stored in a memory means of the controller in advance, and the operator selects a desired path from the stored paths by operating a suitable path selection means (such as a button and a switch) provided at the operator's seat in the cabin 5. Then, the controller determines and controls the extending and retracting operation of the counter cylinder 12 according to the selected path. Alternatively, it may be so arranged and controlled that the path of movement of the front end of the lift arm 6 is finely adjusted by selecting parameters in numeric values for the degrees of retraction and extension of each of the cylinders 11 and 12.

Figure 7:
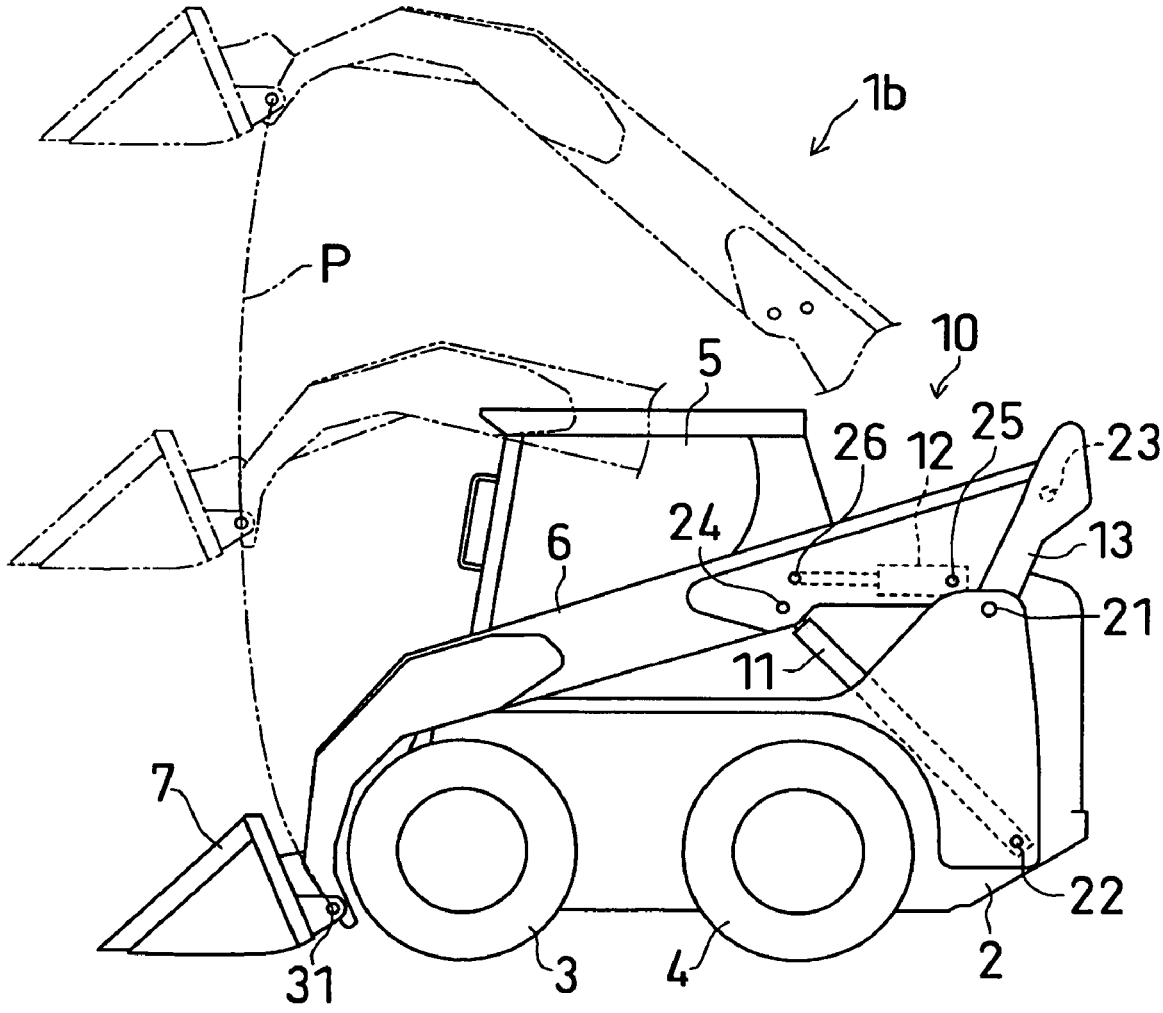
FIG. 7 is a side view of a skid steer loader according to a second first preferred embodiment of the present invention showing a bucket and a lift arm in a plurality of positions.

The following will describe the skid steer loader of a second preferred embodiment according to the present invention with reference to FIG. 7 showing a side view of the skid steer loader 1*b*. As shown in FIG. 7, the skid steer loader 1*b* includes the base 2 and the lift arm 6 mounted thereon. The lift arm 6 is operable to be raised and lowered substantially in the same manner as the counterpart of the first preferred embodiment. The lift arm 6 has a front end to which the bucket 7 is pivotally connected through the pin 31.

The lift arm 6 is connected to the base 2 through the two cylinders 11 and 12 and the connecting rod 13. The lift cylinder 11 is pivotally connected at one end (or rod end) thereof to the lift arm 6 through the pin 24 and at the other end (or base end) thereof to the rear lower portion of the base 2 through the pin 22. Alternatively, the lift cylinder 11 may also be joined to the vehicle by an indirect connection from its base end to the pin 22 at the rear lower portion of the base 2 through a linkage or the like. The counter cylinder 12 is pivotally connected at one end (or rod end) thereof to the lift arm 6 through the pin 26 and at the other end (or base end) thereof to the base 2 through the pin 25. Alternatively, the counter cylinder 12 may also be joined to the vehicle by an indirect connection from its base end to the pin 25 at the base 2 through a linkage or the like. The connecting rod 13 is pivotally connected at its upper end to the proximal end of the lift arm 6 through the pin 23 and at its opposite lower end to the base 2 through the pin 21. Alternatively, the connecting rod 13 may also be joined to the vehicle by an indirect connection from its lower end to the pin 21 at the base 2 through a linkage or the like.

The second preferred embodiment differs from the first preferred embodiment in that the connecting rod 13 is arranged on the rear side of the vehicle. Specifically, the connection points of the connecting rod 13 (or the pin 23), the counter cylinder 12 (or the pin 26) and the lift cylinder 11 (or the pin 24) to the lift arm 6 are arranged in this order from the proximal end of the lift arm 6 toward the front end thereof.

With the lift arm 6 located at the lowermost position as indicated by the solid line in FIG. 7, the lift cylinder 11 is directed upwardly and forwardly as seen from the pin 22, and the counter cylinder 12 is directed substantially horizontally and forwardly as seen from the pin 25. The connecting rod 13 is tilted slightly rearwardly.

For raising the lift arm 6 for loading or unloading operation from its lowermost position that is indicated by solid line in FIG. 7, the lift cylinder 11 is extended and the counter cylinder 12 is retracted slightly during the initial period of such extension of the lift cylinder 11. Then, the counter cylinder 12 is extended. By so doing during the initial period of raising the lift arm 6, the connecting rod 13 is pivoted to tilt rearwardly of the vehicle due to the retraction of the counter cylinder 12, and the front end of the lift arm 6 is moved rearwardly. During the late period of raising the lift arm 6 when the counter cylinder 12 is extended, the front end of the lift arm 6 is moved forwardly. Therefore, the path P of movement of the front end of the lift arm 6 (or the end thereof to which the bucket 7 is connected) describes an arched curve that is substantially straight and vertical as indicated by the chain double-dashed line in FIG. 7. As a result of such arrangement and operation, a longer reach is obtained in the uppermost position of the lift arm 6, thereby improving the workability in loading and unloading operation.

As in the first preferred embodiment, the path of movement of the front end of the lift arm 6 can be changed by varying the lengths of extension and retraction of the cylinders 11 and 12.

Figure 8:
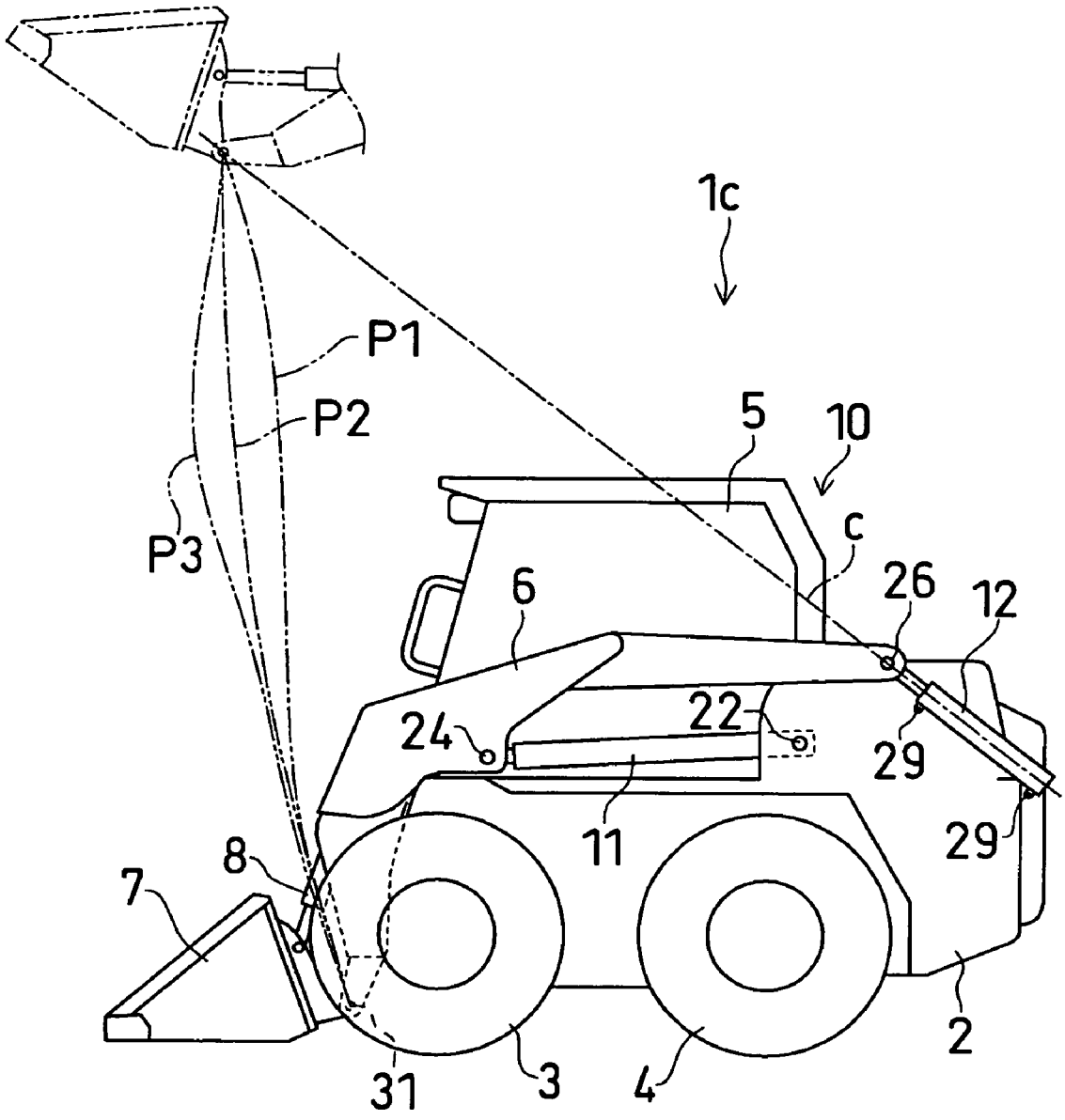
FIG. 8 is a side view of a skid steer loader according to a third first preferred embodiment of the present invention showing a bucket and a lift arm in a plurality of positions.

The following will describe the skid steer loader of a third preferred embodiment with reference to FIG. 8 showing a side view of the skid steer loader. The third preferred embodiment differs from the first preferred embodiment in that the skid steer loader 1*c* dispenses with the connecting rod 13 and also that the connection manner of the counter cylinder 12 to the base 2 is modified. More specifically, the cylinder portion of the counter cylinder 12 is fixed to the base 2 through fixing means 29 such as bolts so that the counter cylinder 12 is immovable. Alternatively, the cylinder portion of the counter cylinder 12 may also be joined to the vehicle by an indirect connection at the base 2 through a linkage or the like. The axis c of the counter cylinder 12 is tilted upwardly and forwardly so that it forms an angle with the horizontal plane. Thus, the movable rod of the counter cylinder 12 is guided by the counter cylinder 12 in the direction of the axis c.

Like the first preferred embodiment, the lift cylinder 11 of the third embodiment of FIG. 8 is pivotally connected at one end (or rod end) thereof to the middle portion of the lift arm 6 through the pin 24 and at the other end (or base end) thereof to the base 2 through the pin 22. Alternatively, the lift cylinder 11 may also be joined to the vehicle by an indirect connection from its base end to the pin 22 at the base 2 through a linkage or the like. The counter cylinder 12 is connected at one end on the movable rod side (or rod end) thereof to the proximal end of the lift arm 6 through the pin 26 so that the lift arm 6 is pivotal about the pin 26. In the third preferred embodiment, the positions of the pins 24 and 26 correspond to first and second connection points of the present invention, respectively.

In the third preferred embodiment, the point of the pin 26 (or the second connection point) which pivotally connects the counter cylinder 12 to the lift arm 6 is guided by the counter cylinder 12 for movement in the direction of the axis c. The second connection point (or the point of the pin 26) corresponds to a guide connection point of the present invention.

With the lift arm 6 located at its lowermost position indicated by the solid line in FIG. 8, the lift cylinder 11 is directed forwardly and substantially horizontally as seen from the pin 22, and the counter cylinder 12 is extended slightly. For raising the lift arm 6 from the position indicated by the solid line in FIG. 8 for loading or unloading operation, the lift cylinder 11 is extended and the counter cylinder 12 is retracted slightly during the initial period of such extension of the lift cylinder 11. Then, the counter cylinder 12 is extended. By so doing during the initial period of raising the lift arm 6, the front end of the lift arm 6 is moved rearwardly due to the retraction of the counter cylinder 12. During the late period of raising the lift arm 6 when the counter cylinder is extended, the front end of the lift arm 6 is moved forwardly. Therefore, the path of movement of the front end of the lift arm 6 describes a substantially straight and vertical line as indicated by the chain double-dashed line P1 in FIG. 8. As a result, a longer reach of the bucket 7 is obtained at the uppermost position of the lift arm 6 indicated by the chain double-dashed line in FIG. 8, thereby improving the workability in loading and unloading operation. In the third preferred embodiment, the path of movement of the front end of the lift arm 6 can be changed, for example, to P2 or P3 by varying the lengths of extension and retraction of the cylinders 11 and 12.

Since the connecting rod 13 is dispensed with in the third preferred embodiment, the number of parts for the vehicle is reduced and, therefore, the construction of the vehicle is simpler as compared to the those of the first and second preferred embodiments. The pin 26 as the second connection point is guided for movement in the oblique direction (the direction of the axis c) which forms an angle with the horizontal plane, thereby reducing the space required for the movement of guide mean (or the counter cylinder 12 in the third preferred embodiment) and the pin 26, specifically in the longitudinal direction of the vehicle. Thus, the raising and lowering device 10 and hence the skid steer loader 1*c* is made smaller in size. Furthermore, since the pin 26 (or the second connection point) is linearly guided by the movable rod of the counter cylinder 12 which is connected at the second connection point, additional element such as rail for guiding the pin 26 is not required and, therefore, the construction of the vehicle is simple and the production cost therefor is reduced.

The direction in which the pin 26 is guided corresponds to the axial direction of the counter cylinder 12. Thus, the stroke of the counter cylinder 12 is effectively used to ensure a large stroke of movement of the guide connection point, which enhances the degree of freedom of varying the path of movement of the front end of the lift arm 6.

As shown in FIG. 8, the front end of the lift arm 6 raised to the uppermost position lies substantially on the hypothetical line which is drawn from the pin 26 along the guided direction of the pin 26 (or the direction of the axis c of the counter cylinder 12). By so setting the guided direction of the pin 26 (the direction of the axis c of the counter cylinder 12), load applied from the bucket 7 to the lift arm 6 at its uppermost position is received by the counter cylinder 12, thereby further increasing the maximum load capacity of the vehicle.

A plurality of the preferred embodiments according to the present invention are described above, but they may be modified as follows.

(1) The working implement is not limited to the bucket 7. For example, a fork is usable as the working implement. The work implement may be detachably connected to the front end of the lift arm 6.

(2) The directions and the positions of the two cylinders 11 and 12 and the connecting rod 13 shown in FIGS. 1 and 7 in the first and second preferred embodiments may be changed according to a desired path of the front end of the lift arm 6 and a desired raised amount of the lift arm 6. Similarly, the directions and the positions of the two cylinders 11 and 12 shown in FIG. 8 in the third preferred embodiment may be changed.

(3) In the third preferred embodiment shown in FIG. 8, the pin 26 is guided by the counter cylinder 12. Alternatively, a rail or a rod may be provided on the base 2 for guiding the pin 26 in the oblique direction which forms an angle with the horizontal plane.

(4) In the third preferred embodiment shown in FIG. 8, the cylinder portion of the counter cylinder 12 is fixed to the base 2 so that the counter cylinder 12 is immovable. Alternatively, the cylinder portion of the lift cylinder 11 may be fixed to the base 2 so that the lift cylinder 11 is immovable. In this case, the lift cylinder 11 which is disposed horizontally in FIG. 8 should be arranged in an upright position or extending substantially vertically. The counter cylinder 12 is connected at one end on the cylinder portion side (or base end) thereof to the base 2 and at the other end on the movable rod side (or rod end) thereof to the lift arm 6, for example, as shown in FIG. 1. According to such modified construction, the path of movement of the front end of the lift arm 6 can be changed by varying the lengths of extension and retraction of the cylinders 11 and 12.

(5) The connection of the cylinders 11 and 12 and the connecting rod 13 to the base 2 and the lift arm 6 is not necessarily provided by a pin. Other connections are usable as long as they provide pivotal connection. A pair of the lift arms 6, the cylinders 11 and 12 and the connecting rod 13 are provided on both sides of the vehicle in the above-described preferred embodiments. Alternatively, two pairs or more of them may be provided in the vehicle.

(6) The present invention is preferably applied to the skid steer loader but it is applicable to other types of industrial vehicles.

The present examples and embodiments are to be considered as illustrative and not restrictive, and the invention is not to be limited to the details given herein but may be modified within the scope of the appended claims.

What is claimed is:

1. A lift arm device for an industrial vehicle comprising:

a lift arm having a front end to which a working implement is connected;

a connecting rod pivotally connected at one end to the lift arm and pivotally joinable at the other end to the vehicle;

first and second cylinders each pivotally connected at one end to the lift arm and pivotally joinable at the other end to the vehicle; and a controller for controlling the first and second cylinders, wherein the first cylinder is extended when the lift arm is raised from a lowermost position to an uppermost position, and wherein the second cylinder is initially retracted and then extended during the period of extending the first cylinder.

2. The lift arm device according to claim 1, wherein the lift arm has a proximal end, and wherein connection points of the second cylinder, the connecting rod and the first cylinder to the lift arm are arranged in this order from the proximal end of the lift arm toward the front end thereof.

3. The lift arm device according to claim 1, wherein the lift arm has a proximal end, and wherein the connection points of the connecting rod, the second cylinder and the first cylinder to the lift arm are arranged in this order from the proximal end of the lift arm toward the front end thereof.

4. The lift arm device according to claim 1, wherein the second cylinder is retracted during the initial period of extending the first cylinder.

5. The lift arm device according to claim 1, wherein extension and retraction of the second cylinder are varied in accordance with extension and retraction of the first cylinder when raising and lowering the lift arm, thereby changing a path of movement of the front end of the lift arm.

6. The lift arm device according to claim 5, further comprising an operator control means for changeably manipulating the path of movement of the front of the lift arm.

7. An industrial vehicle comprising a lift arm device according to claim 1.

8. The industrial vehicle according to claim 7, wherein the industrial vehicle is a skid steer loader.

9. A method of raising and lowering a lift arm in an industrial vehicle, the lift arm having a front end to which a working implement is connected, the method comprising the steps of:

pivotally connecting a connecting rod at one end to the lift arm and pivotally joining at the other end to the vehicle;

pivotally connecting a first cylinder at one end to the lift arm and pivotally joining at the other end to the vehicle;

pivotally connecting a second cylinder at one end to the lift arm and pivotally joining at the other end to the vehicle;

extending the first cylinder when the lift arm is raised from a lowermost position to an uppermost position;

retracting the second cylinder during the period of extending the first cylinder; and extending the second cylinder during the period of extending the first cylinder after the second cylinder retracts.

10. The method according to claim 9, wherein the retracting step is carried out during the initial period of extending the first cylinder.

11. The method according to claim 9, further comprising the step of varying extension and retraction of the second cylinder in accordance with extension and retraction of the first cylinder when raising and lowering the lift arm, thereby changing a path of movement of the front end of the lift arm.

* * * * *